United States Patent [19]

Cronk

[11] 4,080,725

[45] Mar. 28, 1978

[54] FERROMAGNETIC CORE WITH VARIABLE SHUNT AIR GAP AND METHOD OF MAKING IT

[75] Inventor: Edward R. Cronk, Indianapolis, Ind.

[73] Assignee: Thomas & Skinner, Inc., Indianapolis, Ind.

[21] Appl. No.: 761,416

[22] Filed: Jan. 21, 1977

Related U.S. Application Data

[62] Division of Ser. No. 483,310, Jun. 26, 1974, abandoned.

[51] Int. Cl.[2] ..... H01F 41/02

[52] U.S. Cl. ..... 29/609; 336/165; 336/178; 336/212

[58] Field of Search ..... 29/609; 336/165, 160, 336/178, 212

[56] References Cited

U.S. PATENT DOCUMENTS

| | | | |
|---|---|---|---|
| 2,456,457 | 12/1948 | Somerville | 29/609 X |
| 2,460,656 | 2/1949 | Sliwiak | 336/165 X |
| 2,523,071 | 9/1950 | Somerville | 29/609 X |
| 2,567,717 | 9/1951 | Lagerlof | 336/165 X |
| 2,639,355 | 5/1953 | Dunsheath | 200/278 |
| 2,934,727 | 4/1960 | Cornell | 336/212 |
| 2,996,656 | 8/1961 | Sola | 336/165 X |
| 3,112,439 | 11/1963 | Rosin | 336/165 X |
| 3,456,223 | 7/1969 | Smith | 336/165 |
| 3,546,571 | 12/1970 | Fletcher et al. | 336/165 X |
| 3,693,127 | 9/1972 | Smith | 336/165 X |

*Primary Examiner*—Carl E. Hall

*Attorney, Agent, or Firm*—Jenkins, Coffey & Hyland

[57] ABSTRACT

A constant voltage transformer or other ferromagnetic device in which operating characteristics depend on the effective length of the air gap in a shunt forming part of the magnetic core structure. Different effective air gaps are obtained, using identically the same core lamination sets (which may be in a low-scrap pattern) by (a) forming shunt laminations of a length to provide a maximum air gap length and with a longitudinally offset rivet hole, offset by slightly less than half the maximum air gap length, (b) stacking the shunt laminations on a rivet in a stacking pattern in which the long ends of some laminations are oriented inward and the long ends of others oriented outward so as to produce a shunt stack with the laminations in a staggered relationship, and (c) varying the stacking pattern to thereby vary the proportion of outward to inward-oriented laminations. The stacking pattern, e.g., 1 out × 1 in; 1 out × 2 in; 2 out × 5 in; 1 out × 3 in; 1 out × 4 in; etc., may be selected by the designer from predetermined data to give effective air gaps in small steps over a wide range of values, from about 20 percent to 100 percent of the maximum air gap.

Use of the same identical lamination sets to obtain different air gaps greatly reduces lamination tooling costs and inventory sizes. The staggered shunt stacks also provide load-responsive regulation of the transformer.

10 Claims, 14 Drawing Figures

FERROMAGNETIC CORE WITH VARIABLE SHUNT AIR GAP AND METHOD OF MAKING IT

CROSS-REFERENCE

This is a division of application Ser. No. 483,310, filed June 26, 1974, now abandoned.

BACKGROUND OF THE INVENTION

This invention relates to ferromagnetic devices, such as ferroresonant devices, constant voltage transformers, reactors, and the like, having a magnetic core which contains a shunt in which variation in the length of an air gap will change the operating characteristics of the device. The invention relates especially to means of providing different effective air gaps and thereby obtaining different operating characteristics.

Such devices are exemplified by constant voltage transformers of the general type shown in Sola U.S. Pat. No. 2,143,745 of Jan. 10, 1939. In such constant voltage transformers, operation depends on the presence in the magnetic core structure of one or more magnetic shunts which include air gaps, and the particular operating characteristics of the transformer depend on the effective air gap lengths in the shunts.

The magnetic core structures of such transformers are commonly made from stacks of laminations, such as E-I laminations, which form spaced main core legs on opposite sides of a window. The shunt legs of the cores are preferably and commonly made as stacks of separate shunt laminations of a length to extend across the window, but shorter than the width of such window by a predetermined amount so as to define an air gap of predetermined length. Sets of laminations are commonly stamped from sheet stock in a low-scrap E-I pattern in which the I-laminations and the shunt laminations are formed from stock in the windows of the E-laminations.

The sheet stock used is preferably grain-oriented and has a preferred direction of flux flow. The laminations are cut so that the direction of grain orientation and flux flow extends lengthwise of the center and side legs of the E-lamination, and lengthwise of the I-lamination. The shunt laminations are preferably stamped with such preferred direction running lengthwise therein.

It is common practice to punch bolt holes at the ends of the back leg of each E-lamination and at the ends of the I-lamination, and to punch a single rivet hole through the exact center of the shunt laminations, so that the stacks of laminations can be fastened together when assembled in a transformer.

In such prior practice, if it is desired to have a different air gap in the shunt of the laminated core structure, it is necessary to produce shunt laminations of a different length. In practice and for economical production, core laminations are commonly punched in complete sets from strip stock in a progressive die, so that to produce shunt laminations of a different length in such case requires the making of a new progressive die for the entire set of laminations. Alternatively, the different length shunts can be cut to precise length from strip stock slit to the required shunt width. Either method is expensive and requires extra tools and extra inventory.

It is also known, as from Smith U.S. Pat. No. 3,456,223 of July 15, 1969, that the performance of constant voltage transformers under varying loads is improved by stacking the shunt laminations in an offset arrangement, with a center bundle of laminations displaced longitudinally to abut one leg of the magnetic core structure and with side bundles of the laminations displaced in the opposite direction to engage the opposite leg of the magnetic core structure. With such offset arrangement, at low load current levels the juxtaposed bundles of shunt laminations provide an essentially low-reluctance path which extends from the side bundles to the center bundle and which contains substantially no air gap at either end, whereas at higher load current levels the flux path extends directly through the individual bundles and across the air gaps at their ends. In the Smith patent, the staggered relationship of the center and side bundles of laminations is obtained by inserting a gap spacer at the end of at least one bundle of laminations to position the bundles in offset relationship.

The present invention provides a means for providing different effective air gaps and correspondingly different operating characteristics while using identically the same core lamination sets, including the same identical shunt laminations. The lamination sets for devices having different effective air gaps and correspondingly different characteristics may be made in the conventional economical manner on the same progressive dies, and may be in a low scrap pattern. The invention also provides the same benefits as the disclosure of the Smith patent.

SUMMARY OF THE INVENTION

In accordance with the invention, sets of core laminations are punched in the usual way except only that the center hole in each shunt lamination is displaced longitudinally a short distance from the longitudinal center of the lamination, and that the shunt laminations are made of a length to provide an air gap of a maximum useful length. For present purposes the center hole may be referred to as an alignment hole. The amount of displacement or offset of the alignment hole does not exceed one-half the said maximum air gap length, and is preferably equal to one-half the difference between the maximum air gap length and a minimum clearance dimension required for convenient assembly of the core structure. For example, if the maximum useful gap length is 0.067 inch, and the minimum physical clearance required is 0.007 inch, the difference is 0.060 inch, and half that difference is 0.030 inch, and such value is the amount by which the alignment hole of the shunt lamination is offset from the exact longitudinal center of the lamination. One end of the lamination, measured from the center of the hole, will then be longer by 0.060 inch than the other end.

With shunt laminations having such offset center holes, shunt legs for the core structure are formed by stacking the laminations on a supporting rivet or other alignment tool in a stacking pattern in which some laminations have their long ends oriented in one direction and others have their long ends oriented in the other direction, so that the laminations are staggered in the stack.

Different effective or equivalent air gaps are obtained by varying the stacking pattern to vary the proportion of laminations oriented in each direction. For example, as one extreme case, all of the laminations may be stacked with their long ends oriented in the same direction (so that the lamination ends are all even, as in a conventional stack), and this gives a shunt leg having an overall length equal to the length of the shunt laminations and provides a maximum air gap in the shunt when the shunt leg is assembled in the core structure. At the opposite extreme, the laminations may be stacked in a staggered pattern with single or small groups of laminations alternately oriented in opposite directions so that half are oriented one way and half the other way; and this gives a shunt leg which has a maximum overall physical length and which provides a minimum physical clearance gap between itself and the sides of the window of the core structure in which the shunt leg is assembled. However, with such staggered stacking of identically the same laminations but with half the laminations each way, the shunt leg provides an air gap effect which is much smaller than that of the maximum air gap provided by the leg in which all of the laminations are stacked the same way. In a series of tests it was found that a shunt leg in which the laminations were stacked half one way and half the other way gave an air gap effect ranging from about 20 percent to about 40 percent of that of the maximum air gap, depending on the load level at which the test transformer was operated.

The laminations can be stacked in any desired pattern between the two extremes mentioned above, and with any selected ratio of laminations oriented in opposite directions. Such variation of the stacking pattern and ratio correspondingly varies the equivalent or effective air gap provided by the stacked shunt leg. This permits variation of such effective air gap in small steps over a wide range of from about 20 percent to 100 percent of the maximum air gap.

By way of definition, a staggered-lamination shunt of the present invention is said to have an "effective air gap" or an "equivalent air gap" of a particular value when such shunt has the same effect (at a particular operating level) as a conventional straight-stacked shunt which has a physical air gap of that value.

By means of the present invention, identical sets of laminations, made from the same tools without change, can be assembled to produce constant voltage transformers having different operating characteristics. To do this, identical shunt laminations are stacked in different stacking patterns, with selected proportions of the laminations oriented in each direction, and this produces shunts having different effective air gaps. The stacking patterns and the resulting effective air gaps are variable at will in small steps over a wide range to produce correspondingly different magnetic characteristics in the transformer. Corresponding controlled differences can be obtained in other ferromagnetic devices in a corresponding way.

Moreover, it is found that the effective air gap in a shunt embodying the present invention will have a value which varies with the stacking pattern in a predetermined way. It is thus possible to select a stacking pattern or ratio in accordance with predetermined data and thereby to obtain a desired effective air gap in the shunt. Thus, the effective air gap given by different stacking patterns may be plotted as a proportion or percentage of the maximum available gap resulting from stacking the laminations all one way, and in relation to the center leg flux density at which the shunt is to operate. This gives a family of curves, one for each stacking pattern or ratio, from which a stacking pattern can be selected to produce a desired effective air gap at the design flux density.

By means of the present invention, laminations for a whole series of electromagnetic devices can be made on the same identical tools and the need for different shunt sizes and different tools to produce them is eliminated.

The variable stacking pattern employed in the present invention not only permits selective variation of the effective air gap in the shunt of the core structure of a constant voltage transformer, but the staggered arrangement of the laminations also produces load-responsive characteristics like those disclosed in Smith U.S. Pat. No. 3,456,223, and thus produces a more uniform degree of regulation over a varying range of current loads.

BRIEF DESCRIPTION OF THE DRAWINGS

The accompanying drawings illustrate the invention and by way of example show a preferred embodiment of the invention. In such drawings.

DESCRIPTION OF THE PREFERRED EMBODIMENT

Figure 1:
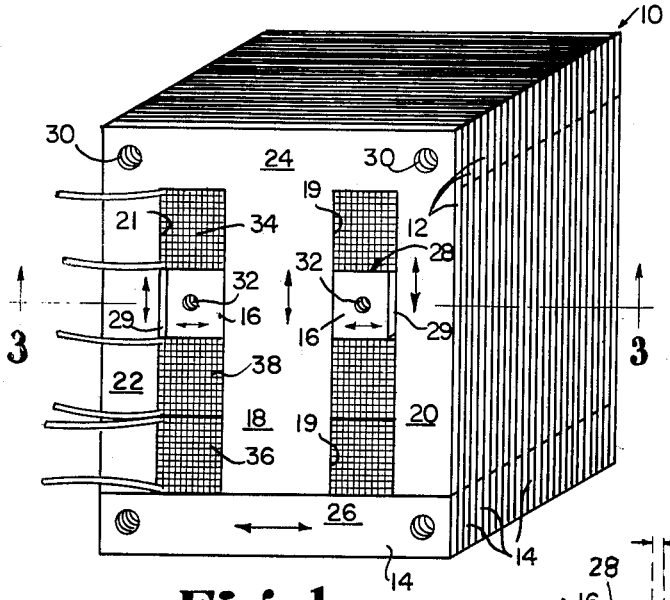
FIG. 1 is an isometric view of an exemplary from of constant voltage transformer having a magnetic core structure form of E-I laminations and having a shunt leg in each window of the core structure.

The transformer shown in FIG. 1 comprises a magnetic core structure 10 formed of sets of laminations including an E-lamination 12, an I-lamination 14, and two shunt laminations 16. In accordance with conventional practice, the laminations are stacked with the E and I-laminations in alternate orientations. The resulting core 10 has a center leg 18, two side legs 20 and 22, and two end legs, and contains two windows 19 and 21. The several laminations are secured together by bolts or other fasteners extending through holes 30 at the corners of the core 10. The shunt laminations 16 are fastened together in stacks by rivets 33 or other fasteners extending through holes 32, the exact position of which will be more fully discussed below. As shown, the rivets 33 are not riveted over, and the laminations are held thereon by self-locking spring fastener clips 35. The shunt stacks so formed are inserted as shunt legs 28 in the windows 19 and 21. The length of shunt laminations is such that, in a conventional core, physical air gaps 29 of precise lengths are formed between one end of each shunt and the opposite core leg. As shown, the gaps 29 are between the shunts 28 and the side legs 20 and 22.

Figure 9:
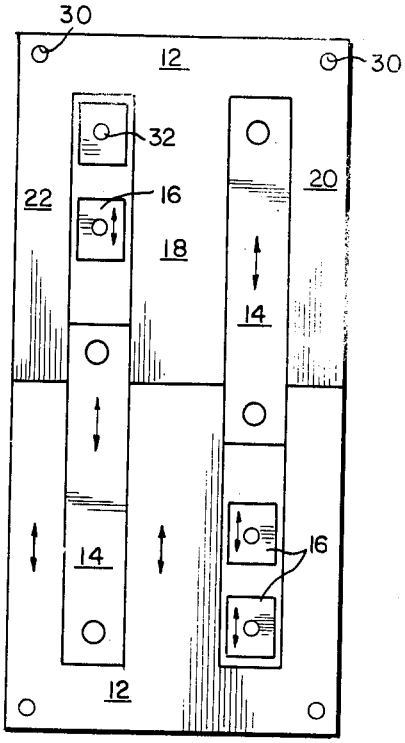
FIG. 9 is a diagrammatic plan view showing the pattern by which sets of E-I laminations and shunt laminations are stamped from strip stock in a low-scrap pattern to provide laminations for making a transformer core as shown in FIG. 1 in which each window contains a single shunt leg.

The lamination sets may be punched from sheet or strip stock in a pattern as shown in FIG. 9, and the stock is desirably a grain-oriented material which has a preferred direction of flux flow as shown by the arrows in FIGS. 1 and 9. That is, the preferred flux-flow direction runs lengthwise in the center and side legs 18, 20, and 22 of the E laminations 12 and lengthwise in the I laminations 14. The preferred flux-flow or grain-orientation direction runs lengthwise in the shunt laminations 16 and such laminations are arranged so that in the core 10 such direction runs transversely in the windows 19 and 21 and perpendicularly to and between the main legs 18, 20, and 22.

In addition to the magnetic core structure 10, the transformer of FIG. 1 comprises three windings, including a primary winding 34, a secondary or output winding 36, and a resonant winding 38. As shown in the diagram of FIG. 2, the primary winding 34 is connected to input terminals 39 and 40, the output winding 36 is connected to output terminals 41 and 42, and the resonant winding 38 is connected across a capacitor 44.

Figure 2:
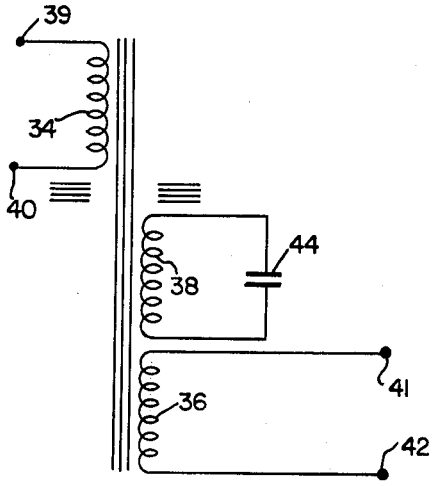
FIG. 2 is a schematic single phase circuit diagram for the voltage stabilizing transformer of FIG. 1.
Figure 3:
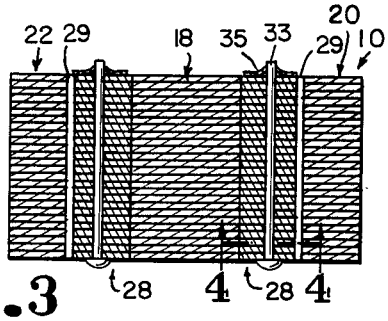
FIG. 3 is a horizontal section taken on the line 3—3 of FIG. 1.

The constant voltage transformer described above, including both the magnetic structure 10 and the electrical circuit of FIG. 2, is, as so far described, a conventional and known transformer of simple and basic construction. It is here set forth to exemplify transformers and other ferroresonant devices and reactors in which the desired operation and operating characteristics depend on the presence of shunt legs 28 in the magnetic core structure and especially on the presence of air gaps of controlled length and effect. The operation of such devices is known, and the operation of the transformer shown may be considered to be as follows: The input terminals 39 and 40 are connected to an unregulated AC input, and the output terminals are connected to a load for which a regulated AC supply is desired. The flux set up in the core structure by reason of the potential across the primary winding 34 will link with the winding 38, and as the operating level is reached, resonance takes place in the resonance circuit composed of the resonant winding 38 and the capacitor 44. Two magnetic circuits are created, one of which includes a leakage path through the shunts 28 and their air gaps 29. Under a state of resonance of the resonant circuit 38-44, part of the magnetic core becomes saturated, and so regulates the coupling between the primary winding 34 and the output winding 36 that the output at the terminals 41 and 42 is a regulated and substantially constant AC output.

The present invention is concerned with construction of the shunt legs 28 and the form of the shunt laminations 16 which permits lamination sets made from the same identical tools in the same identical pattern to be used to produce effective air gaps varying over a wide range.

Figure 4:
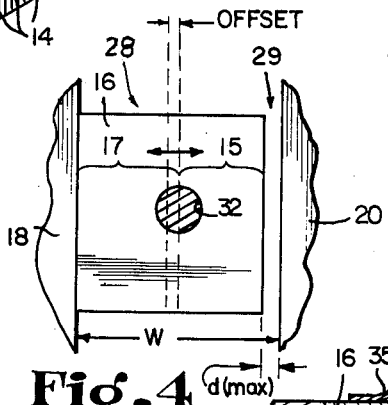
FIG. 4 is a section coplanar with the core laminations of FIG. 3, taken along the line 4—4 of FIG. 3, and showing a shunt lamination in elevation and on an enlarged scale.

This result requires no change in the E or I laminations, and these may be conventional. The shunt laminations, however, require a small but critical change and are as shown in FIG. 4. Their length in relation to the width W of the window 19 is such as to provide a maximum length *d* (max) at the air gap 29, equal to the maximum usable gap length for an entire family or series of transformers or other devices to be made from the same lamination sets. The width or vertical dimension of the shunt lamination 16 is of no importance to the present invention, and may be of any width selected by the designer to provide the desired cross-sectional area in the shunt leg 28.

Figure 6:
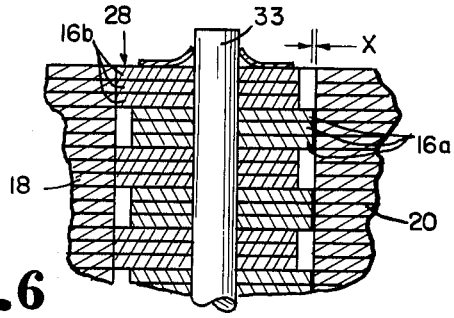
FIG. 6 is a view similar to FIG. 5, showing the shunt laminations stacked in a 3 × 3 pattern, that is, with the shunt laminations stacked in groups of three, with the successive groups oriented in opposite directions in a staggered pattern, i.e., three one way, three the other way, etc.

The position of the rivet hole 32 of the shunt lamination 16 is of prime importance. As shown in FIG. 4, such hole is offset a short distance from the longitudinal center or midpoint of the lamination. The amount of such offset is precisely related to the maximum air gap *d* (max), and should not exceed one-half that maximum air gap length. The hole then divides each lamination into a short end 15 and a long end 17. The purpose of this offset is to allow the laminations to be stacked in a staggered pattern with the rivet 33 holding the holes 32 in alignment. For example, as shown in FIG. 6, the long ends 17 of some laminations **16*a* are oriented outward toward the core side leg 20 and the long ends of other laminations 16*b* are oriented inward toward the core center leg 18. This places the laminations 16*a* in substantial abutment with the leg 20 and the laminations 16*b* are in substantial abutment with the leg 18, and in order to permit physical insertion of the staggered stack of laminations to be inserted in the window 19**, a clearance X is desirably provided between the overall length of the stack and the width W of the window.

The preferred amount of offset of the rivet hole 32 from the center of the shunt laminations 16 is determined by subtracting the clearance X from the maximum air gap length *d* (max), and dividing the result by two. For example, if the maximum air gap *d* (max) is 0.067 inch, and the necessary clearance X is 0.007 inch, the difference will be 0.060 inch, and half of this will be 0.030 inch, and such 0.030 inch will be the amount of offset of the rivet hole 32 from the center of the shunt laminations 16.

The offset of the rivet hole 32 has the effect of placing that hole substantially on the center line of the window 19, and makes the long ends 17 of the laminations substantially equal in length to one-half the width W of the window 19. This allows the laminations to be stacked with their long ends 17 oriented in either direction, as desired.

Figure 12:
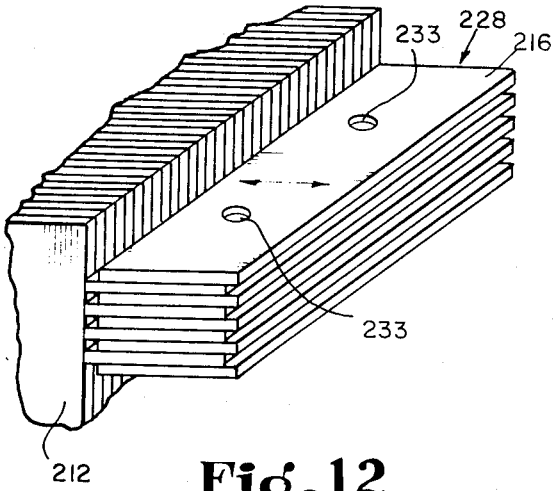
FIG. 12 is an isometric view of a laminated shunt leg in accordance with the present invention and in which the laminations lie at right angles to the planes of the main laminations of the core.

The alignment hole 32 is desirably at the transverse center of the lamination 16 when a single hole is used, but this is not essential, and the hole may be eccentric transversely as well as longitudinally, and more than one hole may be used, as shown in FIG. 12. In any such case, the hole or holes should be offset longitudinally by an amount as explained above and not to exceed one-half the pedetermined maximum air gap length.

Shunt laminations 16 having offset rivet holes 32 may be stacked in various different stacking patterns to obtain different effective air gaps, and a desired effective air gap can be obtained by selecting the stacking pattern in accordance with predetermined data.

By stacking pattern in meant the order or pattern in which the laminations are stacked, and the relationship of laminations stacked with their long ends oriented in opposite directions. A stacking ratio may be obtained from the formula:

$$\text{Stacking Ratio} = N_1/(N_1 + N_2)$$

Where *N HD 1* is the smaller number of laminations stacked with their long ends in eithe direction, $N_2$ is the number of laminations stacked with their long ends in the opposite direction, and $N_1 + N_2$ is the total number of laminations used.

Figure 5:
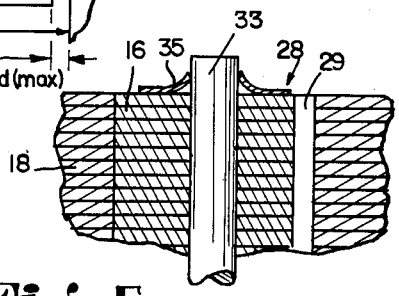
FIG. 5 is a fragmental sectional view in the same plane as FIG. 3 and on the enlarged scale of FIG. 4, showing a shunt leg with the shunt laminations all stacked in the same orientation to give the maximum available air gap.

Examples of different stacking patterns are shown in FIGS. 5–8. In FIG. 5, all the shunt laminations 16 are stacked with their long ends 17 inward, abutting the center leg 18, which leaves a maximum gap 19 between the outer ends of the laminations 16 and the core leg 20, and provides the maximum available air gap in the shunt.

In FIG. 6, the shunt leg 28 is formed by stacking three shunt laminations **16*a* oriented with their long ends outward, then three laminations 16*b* oriented with their long ends inward, then three laminations 16*a*** oriented with their long ends outward, etc. in a staggered pattern of alternating groups of three laminations. This gives what I designate a 3 × 33 stacking pattern, and gives a stacking ratio of 0.50. In a series of tests, such a stacking pattern and ratio was found to provide an effective air gap equal to slightly more than 20 percent of the maximum available air gap under operating conditions with center leg flux densities of 1 kilogauss and 5 kilogauss, and an effective air gap of about 35 percent of the maximum available air gap under operating conditions with a center leg flux density of 15 kilogauss.

Figure 7:
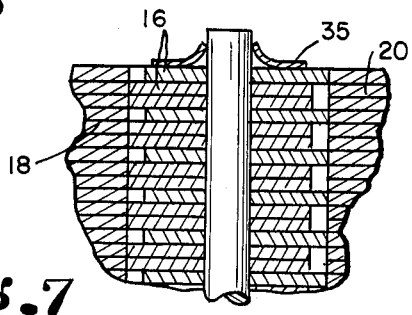
FIG. 7 is a sectional view like FIG. 5, showing the shunt laminations stacked in a 1 × 2 pattern, that is, with one lamination one way, two the other way, etc.

In FIG. 7, the shunt leg 28 is formed by stacking shunt laminations 16 in a 1 × 2 stacking pattern, with one lamination oriented with its long end inward, two laminations oriented with their long ends outward, one with its long end inward, etc. in alternating groups of one lamination inward and two laminations outward. This gives a stacking ratio of 0.33, and provides a shunt having effective air gaps at different operating levels which are somewhat higher proportions of the maximum available air gap.

Figure 8:
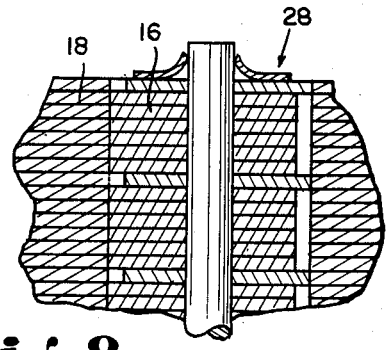
FIG. 8 is a sectional view like FIG. 5, showing shunt laminations stacked in a 1 × 6 pattern, that is, with one out, six in, one out, six in, etc.

In FIG. 8, the shunt leg 28 is formed by stacking laminations 16 in a 1 × 6 stacking pattern, that is, with alternate groups of one lamination with its long end oriented one way and six laminations with their long ends oriented the other way, which gives a stacking ratio of 0.14.

Various other stacking patterns may be used to obtain different stacking ratios from zero (FIG. 5) to 0.50 (FIG. 6), and thereby to obtain effective air gaps varying in small steps over a wide range and to produce corresponding variations in operating characteristics to suit design requirements.

In FIGS. 7 and 8, the shunt legs 28 are shown oriented with the smallest number of laminations 16 extending toward the side leg 20 of the core structure and the larger number of laminations extending toward the center leg 18 of the core structure, and this places the primary air gap effect at the outer end of the shunt leg. But the opposite arrangement can also be used, in which the smaller number of laminations have their long ends oriented toward the center leg 18.

As has been indicated, the different stacking patterns and stacking ratios give different effective air gaps equal to different proportions of the maximum available air gap. It is found that the ratio of effective air gap to maximum air gap for lamination sets of different sizes tends to be uniform for the different sizes so long as the laminations are manufactured to the same general outline aspect ratio formula.

Figure 14:
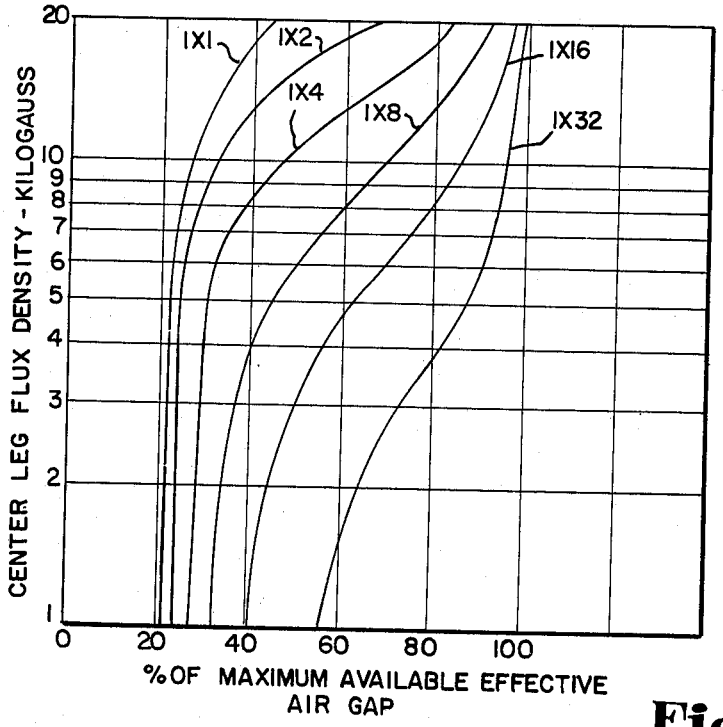
FIG. 14 is a graph showing a family of curves representing variations in "effective air gap" obtained with different lamination stacking patterns in accordance with the present invention, and in relationship to variations in operating level or center-leg flux density.

The family of curves shown in FIG. 14 was developed to indicate the effective air gap length for different stacking ratios and different center leg flux densities.

Figure 13:
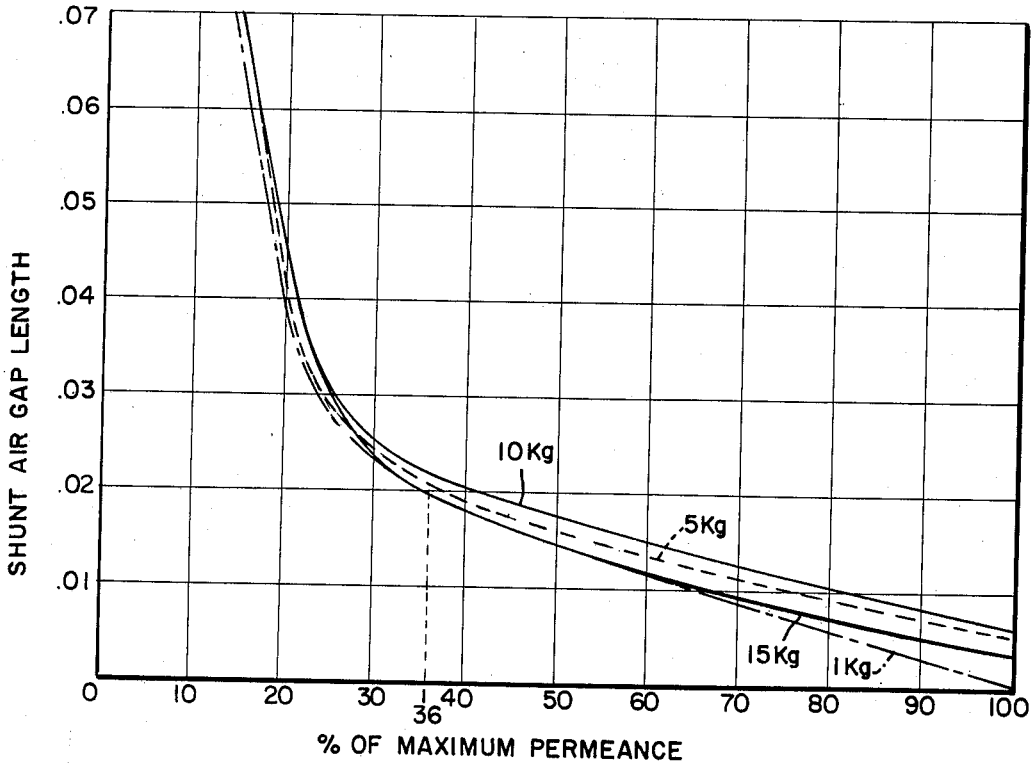
FIG. 13 is a graph of reference curves representing variations in permeance values obtained with certain standard shunts of different physical lengths providing shunt air gaps of different lengths, the four curves representing results at different center-leg flux density levels.

Data for conventional air gaps was first obtained to provide standards for comparison. A test structure was prepared in which the shunts could be removed and replaced. A series of shunts were prepared and carefully measured so that when inserted in the test structure they would give physical measurable air gaps of different lengths, specifically 0.007, 0.017, 0.037, 0.057, and 0.067 inch gap lengths. With a test coil about the center leg of the core structure, the test unit was operated with the center leg of the core at different flux densities, namely, at 1 kilogauss, 5 kilogauss, 10 kilogauss, and 15 kilogauss values. In each test the exciting currents were measured. This gave permeance values for a series of actual air gaps of known lengths. From these values, the curves of FIG. 13 were plotted, showing for each test the air gap length versus the percentage proportion of observed permeance to the maximum available permeance of the system. Such maximum permeance was taken to be that measured at the minimum air gap of 0.007 inch with the center leg flux density at 10 kilogauss.

A series of test shunt legs were then prepared in accordance with the present invention. Shunt laminations 16 as shown in FIG. 4 were prepared having a length measured to provide a maximum air gap *d* (max)of 0.067 inch, and having offset rivet holes 32, offset 0.030 inch from the exact center of the lamination. These were stacked on rivets 33 in a series of different stacking patterns, as exemplified in FIGS. 5–8. These specially stacked shunt legs were then assembled in the test apparatus and tested in the same manner as the standard legs mentioned above, and permeance values were obtained for each stacking pattern at different values of center leg flux density. As before, percentages of the maximum available permeance were derived for each test value and these were applied to the curves of FIG. 13 to read off an equivalent air gap length for each stacking pattern at each flux density.

The resulting equivalent air gap length values were then each divided by the maximum air gap length value to obtain a percentage air gap value for each stacking pattern at each flux density, and such percentage values were plotted against center leg flux density to produce the family of curves shown in FIG. 14.

In FIG. 14, each curve represents the results, at different center leg flux densities, of tests with shunt legs stacked in a particular stacking pattern. Thus, the first curve represents the equivalent effective air gap values at different flux densities of shunts stacked in a 1 × 1 stacking pattern, i.e., one in which one-half the shunt laminations had their long ends one way and the other half had their long ends the other way. This gave a stacking ratio of 0.50. Similarly, the last curve represents the equivalent air gap values at different flux densities of shunts stacked in a 1 × 32 stacking pattern, i.e., one in which the laminations were stacked in alternate groups of one lamination one way and thirty-two laminations the other way. This gave a stacking ratio of 0.03. The intermediate curves show the results with stacking patterns of 1 × 2; 1 × 4; 1 × 8; and 1 × 16.

The curves of FIG. 14 show that by using shunt laminations having offset rivet holes and stacking them in different stacking patterns, in accordance with the present invention, different equivalent air gap lengths are obtained over a wide range of values from 100 percent down to about 20 percent of the maximum gap length. They also show that the variation depends on the operating level as represented by the center leg flux density.

The curves of FIG. 14 further show that any desired equivalent or effective air gap length over a wide range can be obtained with the same identical lamination sets simply by selecting an appropriate stacking pattern. For example, assuming a maximum available air gap of 0.067 inch, if the desired effective air gap length is 0.040 inch, this would be equivalent to 60 percent of the maximum air gap length. If the design operating level is at a center leg flux density of 10 kilogauss, one can read up from the 60 percent point on the horizontal scale of FIG. 14 to the 10 kilogauss line, and there determine that the desired operating point falls midway between the 1 × 4 and 1 × 8 stacking pattern curves, which indicates that a 1 × 6 stacking pattern would give substantially the desired effective air gap.

The curves show further that the effective air gap length produced by each stacking pattern varies with the flux densities and hence with the operating loads, which is advantageous to provide the benefits described in Smith U.S. Pat. No. 3,456,223, namely, more stable output voltage with reduced ripple over a wide range of loads. Also, it will be seen from the curves that different stacking patterns give different patterns of load-responsive regulation, and hence that by selection of the stacking pattern one may vary the load-response pattern.

Figure 10:
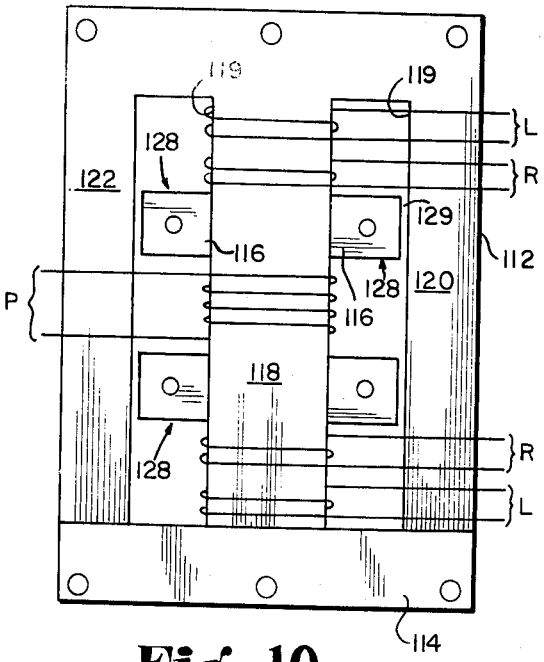
FIG. 10 is a front elevation of a magnetic core structure in which each window contains two shunt legs.
Figure 11:
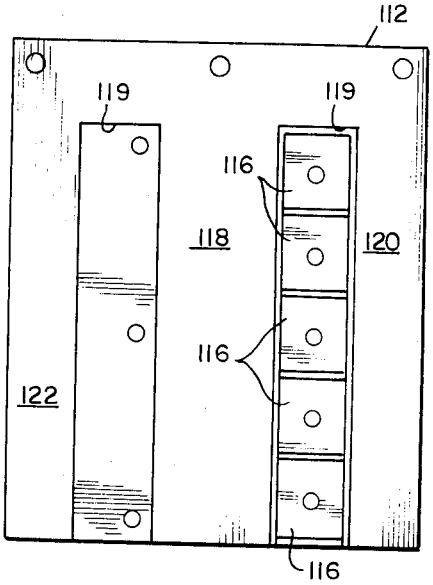
FIG. 11 is a diagrammatic cutting pattern showing how lamination sets for a core as shown in FIG. 10 may be cut from stock material to provide one I-lamination, one E-lamination, and five shunt laminations.

FIGS. 10 and 11 show a modified set of laminations for use in a electromagnetic device which requires a double-shunt core. Such a device is described in the Technical Report by Patrick L. Hunter entitled *Thyristor Controlled Ferroresonant Regulator Utilizing a Double-Shunt Magnetic Structure*, published by North Electric Company, Galion, Ohio 44833. The lamination set in FIGS. 10 and 11 comprises an E-lamination 112, and I-lamination 114, and four shunt laminations 116. The assembled laminations form a long central leg 118, two long side legs 120 and 122, and two pairs of shunt legs 128. As shown in FIG. 10, the core may carry a primary winding P about the center leg between the two pairs of shunt legs, and a pair of resonance windings R and a pair of load windings L about the center leg between the shunt legs and the end legs of the core. As shown in FIG. 11, the windows 119 of the E-lamination 112 are the same size as the I-lamination 114, so that the I-lamination is formed as one of the windows 119 is punched. The window material of the other window 119 is utilized to form five shunt laminations 116. These are narrower than the window 119 and their total length is slightly less than the length of the window 119, so that some small amount of scrap is produced in the punching. In accordance with the present invention, the shunt laminations 116 are cut to a length which provides a maximum air gap 129, and their center rivet holes are offset in the direction of grain orientation of the lamination stock by a distance equal to half the difference between the length of the maximum air gap 129 and the minimum clearance required, as more fully explained in connection with the modification of FIGS. 1–8.

While only four shunt legs 128 are used in the lamination set of FIG. 10, five shunt laminations 116 are conveniently punched from the stock as shown in FIG. 11, in order to provide extra shunt laminations for the convenience of the transformer manufacturer.

In using the shunt laminations 116 of FIGS. 10 and 11, such laminations are stacked in different stacking patterns to obtain different effective air gaps in the same manner as described in connection with the modification of FIGS. 1–8. The results are similar to those represented by the curves shown in FIG. 14.

FIG. 12 shows a further modification. In the modification of FIGS. 1–8, the shunt laminations are punched from window material of the E-lamination of the set, and are stacked in the core structure in an orientation coplanar with the main E and I-laminations. In the modification of FIG. 12, a shunt leg 228 is formed from shunt laminations 216 which lie at right angles to the main laminations 212 of the core structure. Such shunt laminations 216 will ordinarily be too long to be cut from window material of the E-laminations if their grain orientation is to run in a preferred direction as shown by the arrow in FIG, 12. However, they may be cut from stock material with the desired grain orientation, and may still be made in accordance with the present invention.

As shown, the laminations 216 are formed with two rivet holes 232 which are offset from the longitudinal midpoint of the shunt lamination 216 in the direction of grain orientation. The amount of offset is determined in the same way as in the modification of FIGS. 1–8. Such laminations 216 are then stacked on a pair of rivets in different stacking patterns in a manner analogous to that described in connection with FIGS. 1–8 to provide different effective air gap lengths which vary according to the stacking pattern selected.

I claim:

1. The method of making a magnetic core structure which includes a shunt having an effective air gap which is variable in assembly to produce different selected values, which comprises starting with flat shunt laminations of a length to provide a predetermined maximum air gap length, and with each lamination having an alignment hole adjacent the mid-point thereof but offset from such mid-point in the direction of flux flow therein by an amount not exceeding one-half said maximum air gap length, assembling a shunt leg by stacking said flat shunt laminations on an aligning guide with such guide extending through the alignment holes of the successive laminations to align said holes, and orienting the laminations in the stack in a staggered pattern in which successive groups of one or more laminations are oriented with their long ends in opposite directions, and selecting the proportion of laminations oriented in each direction in the stack so that the number of laminations oriented in one direction is substantially not more than half the number oriented in the other direction, so as to provide an effective air gap intermediate that provided by orienting all the laminations in one direction and that provided by orienting generally equivalent numbers of laminations in opposite directions.

2. The method of claim 1 in which the laminations used have their alignment holes offset a distance equal to one-half the difference between said maximum air gap length and a minimum clearance dimension.

3. The method of claim 1 in which the laminations are stacked in a plurality of sets each containing one or more laminations oriented in each opposite direction, so as to distribute the oppositely oriented laminations throughout the stack and to form interfaces between oppositely oriented laminations at a multiplicity of points throughout the stack.

4. The method of making a shunt for a magnetic core structure having a pair of core legs spaced a predetermined distance apart and between which the shunt is to be mounted, which comprises making a plurality of identical flat shunt laminations each having a length less by a predetermined maximum air gap length than said predetermined distance between said core legs, and each having an alignment hole therein offset longitudinally from the longitudinal mid-point of the lamination by a distance not exceeding one-half said predetermined air gap length, and thereby defining a long end on the lamination, stacking said flat laminations on an aligning guide with such guide extending through the holes of the lamination to align such holes, and in a stacking pattern in which successive groups of one or more laminations are alternately oriented with their long ends in opposite directions from the aligning rivet, and securing the laminations in such stacked relationship, and thereby forming a shunt stack which when mounted between said core legs will provide an effective air gap intermediate that produced by a physical gap of said predetermined maximum air gap length and that produced by orienting generally equivalent numbers of laminations in opposite directions, the value of such effective air gap being dependent on the ratio of laminations oriented in one direction to the total laminations, such ratio being defined by the formula:

$$\text{Stacking Ratio} = N_1/(N_1 + N_2)$$

in which $N_1$ is the smaller number of laminations oriented with their long ends in one direction and $N_2$ is the number of laminations oriented with their long ends in the opposite direction, and such ratio being greater than zero and not substantially greater than 0.33.

5. The method of making a shunt for a magnetic core structure having a pair of core legs spaced a predetermined distance apart and between which the shunt is to be mounted, which comprises starting with a plurality of identical flat shunt laminations each having a length less by a predetermined maximum air gap length than said predetermined distance between said core legs, and each having an alignment hole therein offset longitudinally from the longitudinal mid-point of the lamination by a distance not exceeding one-half said predetermined air gap length, and thereby defining a long end on the lamination, stacking said flat laminations on an aligning rod-shaped fastener with such fastener extending through the holes of the lamination and acting to align such holes, and in a predetermined stacking pattern in which successive groups of one or more laminations are alternately oriented with their long ends in opposite directions from the aligning fastener, selecting the proportion of laminations oriented in each direction so that the number of laminations oriented in one direction is substantially not more than half the number oriented in the other direction, so as to form a shunt stack which when mounted between said core legs will provide an effective air gap of a desired value intermediate said maximum air gap length and that produced by orienting substantially the same number of laminations in opposite directions, and securing said fastener to fasten the laminations in such stacked relationship.

6. The method of making a shunt for a magnetic core structure having a pair of spaced core legs, which comprises starting with a plurality of identical flat shunt laminations each having a length less by a predetermined air gap length than the distance between said core legs, stacking said flat laminations in a predetermined stacking pattern of a plurality of successive sets with each set containing a plurality of groups of one or more laminations offset in opposite directions so as to substantially abut the side faces of the spaced core legs, thereby to form interfaces between oppositely offset laminations at a multiplicity of positions in the stack, the proportion of laminations offset in one direction being not more than half those offset in the opposite direction so that the ratio of laminations offset in one direction in relation to the total number of laminations is not substantially greater than 0.33, so as to provide an effective air gap intermediate that produced by positioning all the laminations to abut the same core leg and that produced by offsetting substantially equal numbers of laminations in each direction.

7. The method of making shunts having different effective air gaps for magnetic core structures which each have a pair of core legs spaced a predetermined distance apart and between which a shunt is to be mounted, which comprises starting with a plurality of identical flat shunt laminations each having a length less by a predetermined maximum air gap length than said predetermined distance between said core legs, and each having an alignment hole therein offset longitudinally from the longitudinal mid-point of the lamination by a distance not exceeding one-half said predetermined air gap length, and thereby defining a long end on the lamination, assembling different shunts by stacking said flat laminations on an aligning guide with such guide extending through the holes of the lamination and acting to align such holes, and orienting the laminations in a predetermined stacking pattern in which successive groups of one or more laminations are alternately oriented with their long ends in opposite directions from the aligning guide and with the number of laminations oriented in one direction substantially not more than half the number oriented in the other direction, and varying the proportion of laminations oriented in opposite directions in different shunts to thereby produce shunts which when mounted between said core legs will provide effective air gaps of different values intermediate that produced by orienting all the laminations in one direction and that produced by orienting substantially the same number in opposite directions.

8. The method as in claim 7 in which the aligning guide used is a rivet-like fastener, with the further step of securing said fastener to retain the stacked laminations in the said pattern.

9. The method of making a shunt for a magnetic core structure having a pair of core legs spaced a predetermined distance apart and between which the shunt is to be mounted, which comprises starting with a plurality of identical rectangular flat shunt laminations each having a length less by a predetermined maximum gap length than said predetermined distance between said core legs, and each having an alignment hole therein offset longitudinally from the longitudinal mid-point of the lamination by a distance not exceeding one-half said predetermined air gap length and thereby defining a long end on stacking said laminations in a stack of a series of sets with each set containing some laminations with their long ends oriented in one direction and at least one lamination with its long end oriented in the opposite direction, aligning the holes of the laminations in the stack with an aligning guide extending through all the laminations of the stack, and thereby locating the oppositely oriented laminations in the stack in correspondingly oppositely offset positions therein, and securing the laminations in said oppositely offset positions, thereby forming a shunt having an effective air gap determined by the pattern in which the laminations were oriented in the stack.

10. The method as in claim 9 in which the alignment holes are offset a distance equal to one-half the predetermined air gap lengths and in which said stack contains not more than half as many laminations oriented one way as the other way, thereby forming a shunt having an effective air gap intermediate that provided by offsetting all the laminations in one direction and that provided by orienting generally equivalent numbers of laminations in opposite directions.

* * * * *

UNITED STATES PATENT OFFICE

CERTIFICATE OF CORRECTION

Patent No. 4,080,725 Dated March 28, 1978

Inventor(s) Edward R. Cronk

It is certified that error appears in the above-identified patent and that said Letters Patent are hereby corrected as shown below:

Column 7, line 11, change "in" (first occurrence) to --is--;

line 17, change "N HD 1" to --$N_1$--;

line 18, change "eithe" to --either--;

line 35, change "33" to --3--.

Column 9, line 45, change "a" (first occurrence) to --an--.

Column 14, line 2 (claim 9), after "on" at the end of the line, insert --the lamination,--.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*